US009888760B2

(12) United States Patent
Naramoto

(10) Patent No.: US 9,888,760 B2
(45) Date of Patent: Feb. 13, 2018

(54) ROD-SHAPED COSMETIC CONTAINER

(71) Applicant: HIDAN CO., LTD., Tokyo (JP)

(72) Inventor: Satoru Naramoto, Tokyo (JP)

(73) Assignee: HIDAN CO., LTD. (JP)

( * ) Notice: Subject to any disclaimer, the term of this patent is extended or adjusted under 35 U.S.C. 154(b) by 1 day.

(21) Appl. No.: 15/112,523

(22) PCT Filed: Jan. 31, 2014

(86) PCT No.: PCT/JP2014/052273
§ 371 (c)(1),
(2) Date: Jul. 19, 2016

(87) PCT Pub. No.: WO2015/114801
PCT Pub. Date: Aug. 6, 2015

(65) Prior Publication Data
US 2016/0331103 A1 Nov. 17, 2016

(51) Int. Cl.
*B43K 21/08* (2006.01)
*A45D 40/06* (2006.01)

(52) U.S. Cl.
CPC ..... *A45D 40/06* (2013.01); *A45D 40/065* (2013.01)

(58) Field of Classification Search
CPC ..... A45D 40/06; A45D 40/065
USPC ..... 401/68, 75, 78, 98
See application file for complete search history.

(56) References Cited

U.S. PATENT DOCUMENTS

| | | | | |
|---|---|---|---|---|
| 8,459,890 | B2 * | 6/2013 | Komatsuda | A45D 40/06 132/318 |
| 8,651,759 | B2 * | 2/2014 | Takahashi | A45D 40/00 206/385 |
| 8,985,881 | B2 * | 3/2015 | Hefetz | A45D 40/04 401/98 |

FOREIGN PATENT DOCUMENTS

| | | |
|---|---|---|
| JP | 2007-61393 | 3/2007 |
| JP | 4819973 | 11/2011 |
| JP | 4968973 | 7/2012 |

OTHER PUBLICATIONS

International Search Report.

* cited by examiner

*Primary Examiner* — Jennifer C Chiang
(74) *Attorney, Agent, or Firm* — Gerald E. Hespos; Michael J. Porco; Matthew T. Hespos

(57) ABSTRACT

A cosmetic container (1) has a cap (3) with a first cap portion (11). An inner cylinder (13) is fit internally to an upper part of the first cap portion, and a return spring (20) biases the inner cylinder up. A second cap portion (12) is fit rotatably on the first cap portion. The first cap portion has a temporary holding hole (22) in which a guide protrusion (13*a*) of the inner cylinder is held temporarily against the biasing force of the return spring so that an upper end of the inner cylinder is lower than an upper end portion of the first cap portion when the guide protrusion is held temporarily in the temporary holding hole. Thus, the upper end of the first cap portion can deform to bend inward without being obstructed by the inner cylinder when the second cap portion is fit on the first cap portion.

12 Claims, 12 Drawing Sheets

11
17
M
12
14
2
2c
K
10
5
4

ROD-SHAPED COSMETIC CONTAINER

BACKGROUND

1. Field of the Invention

The present invention relates to a rod-shaped cosmetic container for accommodating rod-shaped cosmetics, such as lipstick, nail polish, foundation, etc.

2. Description of the Related Art

Rod-shaped cosmetic containers that accommodate rod-shaped cosmetics, such as lipstick, foundation, etc., are known and have caps that are fit externally from upper end portions of container bodies in which cosmetics are accommodated to thereby cover to-be-covered portions of the container bodies with the caps.

Rod-shaped cosmetic containers that accommodate cosmetics by external fitting of caps from upper end portions of container bodies as such include an arrangement with an elastic member having a longitudinal biasing force that is mounted in an inner backmost end portion of the cap so as to perform engagement and disengagement of the cap with the container body by using the biasing force of the elastic member.

Such arrangements include, for example, as in Japanese Published Unexamined Patent Application No. 2007-61393, an arrangement for which a cap is composed of an outer cylinder and an inner cylinder that is longitudinally movable with respect to the outer cylinder. A swingable rod formed with a projection portion is provided in a back end portion of the inner cylinder. A guide groove to guide the rod and a latching portion with which the projection portion engages are provided in a back end portion of the outer cylinder. The outer cylinder and the inner cylinder are interposed with an elastic member therebetween so that the inner cylinder moves to the back end portion side of the outer cylinder against a biasing force of the elastic member as a result of pushing in the container body toward the inner back end to bring about an accommodated posture in which the projection portion is engaged with the latching portion. The engagement between the engaging projection and the latching portion is disengaged by again pushing in the container body to the inner back end of the cap, and the cap moves in a direction to disengage from the container body due to the biasing force of the elastic member to bring about a detached posture in which a lower end of the container body is exposed from an opening end of the cap.

However, this arrangement has a problem in that the cap causes the container body to undergo a return movement when the projection portion engages and disengages the latching portion, and a problem that a push-in operation against the elastic member must be performed until the projection portion engages with the latching portion.

Therefore, Japanese Patent No. 4968973 proposes an arrangement with a cap composed of first and second cap portions. The first cap portion is formed with a vertically elongated guide hole. The second cap portion is fit externally to the first cap portion relatively rotatably and is formed with a slanted guide groove. An inner cylinder is fit internally to the first cap portion vertically movably and is formed with a guide protrusion that penetrates through the guide hole and reaches up to the slanted guide groove. Relative rotation between the first cap portion and the second cap portion causes the inner cylinder to move downward so as to project the container body from a lower end of the cap as a result of the guide protrusion being guided by the guide hole and the slanted guide groove. A return spring is provided for returning the second cap portion to a pre-relative rotation position and returning the inner cylinder to an initial position before downward movement, in order to solve the problems of the arrangement in Japanese Published Unexamined Patent Application No. 2007-61393 described above.

With this arrangement in Japanese Patent No. 4968973 described above, a latching portion having a diameter larger than an inner diameter of the second cap portion is formed in an upper end portion of the first cap portion so that the latching portion is fitted into the second cap portion in a force fitting manner so as to latch with a latch receiving portion formed in an upper end portion of the second cap portion when the second cap portion is incorporated by external fitting to the first cap portion. Thus, a downward movement of the first cap portion with respect to the second cap portion is restricted when the second cap portion is incorporated by external fitting to the first cap portion.

Meanwhile, incorporation in this case is achieved by externally fitting the second cap portion to the first cap portion incorporated with the return spring and the inner cylinder by internal fitting. However, the inner cylinder has moved upward to the initial position as a result of being biased by the return spring. Thus, radially inward bending deformation of the upper end portion of the first cap portion is restricted by obstruction of the inner cylinder when performing the force fitting, and consequently, fitting work by force fitting of the latching portion to the second cap portion is not smoothly performed to have a problem of poor workability, and in which problems to be solved by the present invention reside.

SUMMARY

The present invention has been earnestly devised for solving the above-described problems, and a first aspect of the present invention provides a rod-shaped cosmetic container including a container body being filled with a rod-shaped body, such as a rod-shaped cosmetic. A cap is fit externally on the container body from an upper side to accommodate the container body. The cap is composed of a tubular first cap portion with a lower end opened so as to accommodate the container body by external fitting, a tubular second cap portion incorporated by external fitting to an upper part of the first cap portion so as to be rotatable around a longitudinal axis relative to the first cap portion, and an inner cylinder internally fitted to the upper part of the first cap portion vertically movably. One of the first and second cap portions is formed with a first guide portion for guiding in a vertical line shape in a vertical direction, and the other is formed with a second guide portion for guiding in a vertically slanted shape in a circumferential direction. The inner cylinder is formed with an abutting portion that abuts against the container body so that the container body projects from a cap lower end, a first to-be-guided portion that is guided by the first guide portion to move up or down, and a second to-be-guided portion that is guided by the second guide portion to move up or down. The inner cylinder is structured to move down to make the container body project from the cap lower end as a result of the first and second to-be-guided portions being respectively guided by the first and second guide portions to move down, by rotating the second cap portion relative to the first cap portion from an initial posture in which the first and second to-be-guided portions are respectively located at upward movement end positions. The cap is provided with a return spring for returning the second cap portion to a pre-relative rotation position and returning the inner cylinder to the initial posture. An upper end portion of the first cap portion is formed with a latching portion that is fit into the second cap portion in a force fitting manner to latch with a latch receiving portion formed in an upper end portion of the second cap portion when the second cap portion is incorporated by external fitting to the first cap portion, and is arranged so as to restrict a downward movement of the first cap portion with respect to the second cap portion. The upper end portion of the first cap portion is arranged to bend radially inward so that the latching portion of the first cap portion is fit into the second cap portion in a force fitting manner to latch with the latch receiving portion of the second cap portion as a result of the upper end portion of the first cap portion bending radially inward when the second cap portion is fit externally to the first cap portion. A temporary holding portion is provided continuously in the first or second guide portion formed in the first cap portion and temporarily holds the first or second to-be-guided portion removably so that the inner cylinder incorporated by internal fitting into the first cap portion sinks in downward against the return spring so as to allow radially inward bending deformation of the upper end portion of the first cap portion.

According to the above-described aspect of the invention, the external fitting of the second cap portion to the first cap portion can be performed by first moving the inner cylinder incorporated by fitting into the first cap portion against a biasing force of the return spring, then holding the first or second to-be-guided portion by the temporary holding portion to be brought into a temporarily held state, and thereafter externally fitting the second cap portion in a force fitting manner with respect to the first cap portion. The inner cylinder is held temporarily at a position lower than the upper end portion of the first cap portion as a result of the first or second to-be-guided portion being temporarily held by the temporary holding portion at this time. The latching portion formed in the upper end portion of the first cap portion can be deformed to bend radially inward without being obstructed by the inner cylinder when the second cap portion is fit externally to the first cap portion in a force fitting manner. Thus, the external fitting incorporation of the second cap portion with respect to the first cap portion can be performed smoothly. The cap assembling work can therefore be performed easily and reliably.

The second cap portion may be provided with a return portion for returning the first or second to-be-guided portion temporarily held by the temporary holding portion to the first or second guide portion, respectively. Accordingly, the first or second to-be-guided portion temporarily held by the temporary holding portion can be returned to the first or second guide portion by the return portion.

The return portion may be located at a position displaced circumferentially with respect to the first or second to-be-guided portion temporarily held by the temporary holding portion, and abuts against the first or second to-be-guided portion temporarily held by the temporary holding portion and pushes the same away by a relative rotation between the first cap portion and the second cap portion to cause removal of the first or second to-be-guided portion from the temporary holding portion. Thus, the first or second to-be-guided portion temporarily held by the temporary holding portion can be removed from the temporary holding portion through pushing-out with the return portion by rotating the first cap portion and the second cap portion relative to each other.

The first and second guide portions may overlap inside and outside in an upper half portion of the cap so that either one is located inside. Additionally, the first and second to-be-guided portions may be integral, and the integral to-be-guided portion may penetrate through the inner guide portion to be engaged with the outer guide portion. Thus, the first and second guide portions can be arranged in the same radial position of the first or second cap portion, and the temporary holding portion and the return portion can also be arranged in the same radial position of the first or second cap portion. Accordingly, there is no need to provide a large place for arranging the first and second guide portions, the temporary holding portion and the return portion, which allows space saving. Also, integrating the first and second to-be-guided portions allows simplification in structure.

The temporary holding portion may be formed to continue circumferentially with respect to a lower end of the first guide portion, and the return portion may be provided on a longitudinally lower side with respect to a lower end of the second guide portion. Thus, the first or second to-be-guided portion temporarily is held lower than the first or second guide portion, so that radially inward bending deformation of the upper end portion of the first cap portion in a temporarily held state of the inner cylinder can be performed reliably.

The temporary holding portion and the lower end of the first guide portion may be provided continuously while being interposed with an extension portion, and the return portion is formed in an extending portion that is extended toward a lower side than a lower end position of the second guide portion so as to correspond to a position of the temporary holding portion. Thus, the inner cylinder is held temporarily yet lower than the lower end of the first or second guide portion, and radially inward bending deformation of the upper end portion of the first cap portion can be performed more reliably without being obstructed by the inner cylinder. Accordingly, the external fitting of the second cap portion to the first cap portion can be performed more smoothly.

The temporary holding portion is formed to continue circumferentially with respect to a lower end of the second guide portion, and the return portion is provided on a longitudinally lower side with respect to a lower end of the first guide portion. Thus, the first or second to-be-guided portion temporarily is held lower than the first or second guide portion, so that radially inward bending deformation of the upper end portion of the first cap portion in a temporarily held state of the inner cylinder can be performed reliably.

The temporary holding portion and the lower end of the second guide portion may be provided continuously while being interposed with an extension portion, and the return portion is formed in an extending portion that is extended toward a lower side than a lower end position of the first guide portion so as to correspond to a position of the temporary holding portion. Accordingly, the external fitting of the second cap portion to the first cap portion can be performed more smoothly.

At least one upper end portion of the first or second guide portion formed in the first cap portion may be provided like a slit that is notched up to an upper end of the first cap portion to allow radially inward bending deformation of the upper end portion of the first cap portion. Thus, the upper end portion of the first cap portion can bend and deform more easily.

DETAILED DESCRIPTION

Figure 1:
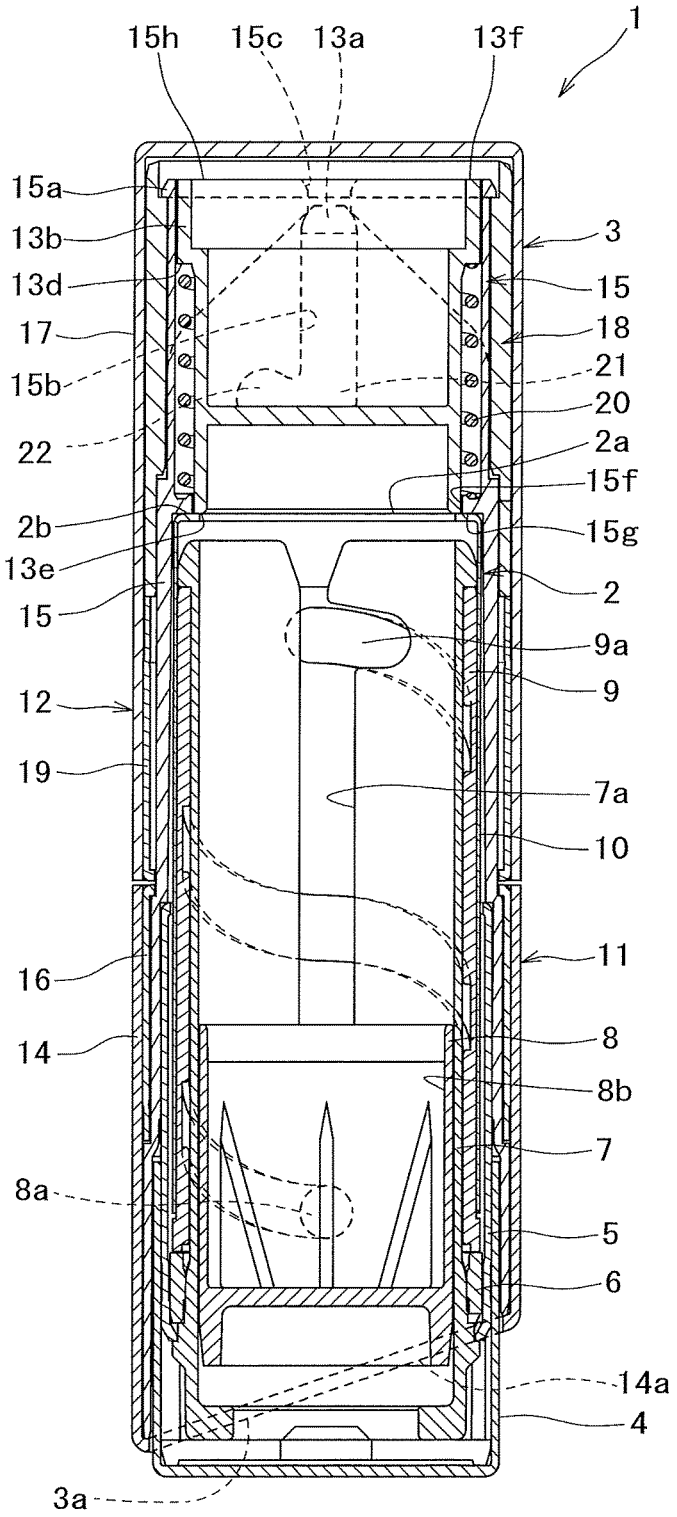
FIG. 1 is a longitudinal sectional view of a first embodiment of the present invention in an initial posture in which a guide protrusion is located at an upward movement end.
Figure 2:
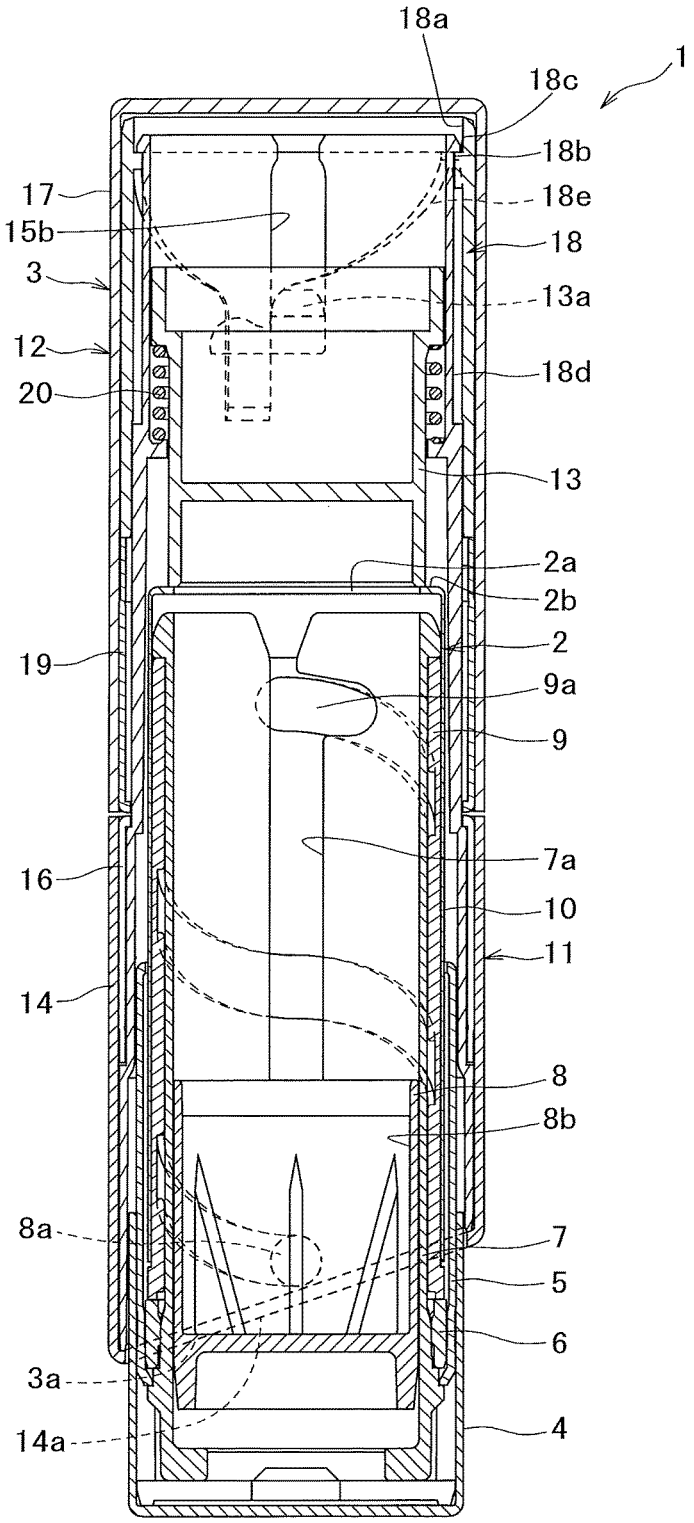
FIG. 2 is a longitudinal sectional view of the first embodiment of the present invention in a downward-moving posture in which the guide protrusion is located at a downward movement end.

Hereinafter, a first embodiment of the present invention will be described in detail on the basis of the drawings.

In the drawings, reference numeral 1 denotes a cosmetic container. The cosmetic container 1 is made up of a container body 2 which has an opening portion 2*a* in its upper surface and of which a rod-shaped cosmetic K (to be) accommodated projects or retracts through the opening portion 2*a* by being operated to ascend or descend, and a cap 3 to cover the container body 2 by being externally fitted to the container body 2 from the side of the opening portion 2*a*.

The container body 2 is provided in a bottom portion thereof with a tubular bottomed petticoat cylinder 4. At an inner circumferential surface of the petticoat cylinder 4, a tubular middle tool 5 is integrally attached in a manner of projecting from an upper portion of the petticoat cylinder 4. Moreover, a ring 6 is internally fitted to an inner circumferential surface of a lower portion of the middle tool 5 so as to rotate integrally with the middle tool 5, and at an inner circumferential surface of the ring 6, a tubular body cylinder 7 extending longitudinally up to an upper portion of the container body 2 is provided so as to rotate integrally with the ring 6. A circumferential surface portion of the body cylinder 7 is provided at circumferentially opposite positions thereof with a pair of longitudinal holes 7*a* which are longitudinally elongated and bent at an upper end portion to one side in a direction around the axis. Moreover, the petticoat cylinder 4, the middle tool 5, the ring 6, and the body cylinder 7 integrally rotate around a longitudinal axis of the container body 2.

On the other hand, on an outer circumferential surface side of the body cylinder 7, a spiral cylinder 9 in which a spiral groove 9*a* is carved from a lower end portion of an inner circumferential surface up to an upper end portion is provided rotatably with respect to the body cylinder 7. Moreover, to an outer circumferential surface of the spiral cylinder 9, a tubular gripping cylinder 10 that rotates integrally with the spiral cylinder 9 is externally fitted, and thereby the gripping cylinder 10 is made rotatable with respect to the petticoat cylinder 4 and the middle tool 5.

On an inner circumferential surface side of the body cylinder 7, a middle plate 8 that is in a tubular bottomed shape and is provided at circumferentially opposite positions of an outer circumferential surface thereof with a pair of protrusions 8*a* is provided while the protrusion 8*a* is engaged slidably with respect to the longitudinal hole 7*a* and the spiral groove 9*a*. Moreover, due to a relative rotation between the body cylinder 7 and the spiral cylinder 9, the protrusion 8*a* is guided ascendingly and descendingly by the spiral groove 9*a* while being rotation-controlled by the longitudinal hole 7*a* to ascend and descend vertically along the longitudinal hole 7*a*, so that the middle plate 8 moves ascendingly and descendingly inside the body cylinder 7. An inner portion of the middle plate 8 is provided as an accommodating portion 8*b* that accommodates the rod-shaped cosmetic K. Rotating the petticoat cylinder 4 or the middle tool 5 relative to a gripping cylinder 10 causes a relative rotation between the body cylinder 7 and the spiral cylinder 9 to move the middle plate 8 ascendingly and descendingly, whereby making the rod-shaped cosmetic K project and retract through the opening portion 2*a* of the container body 2.

Figure 3:
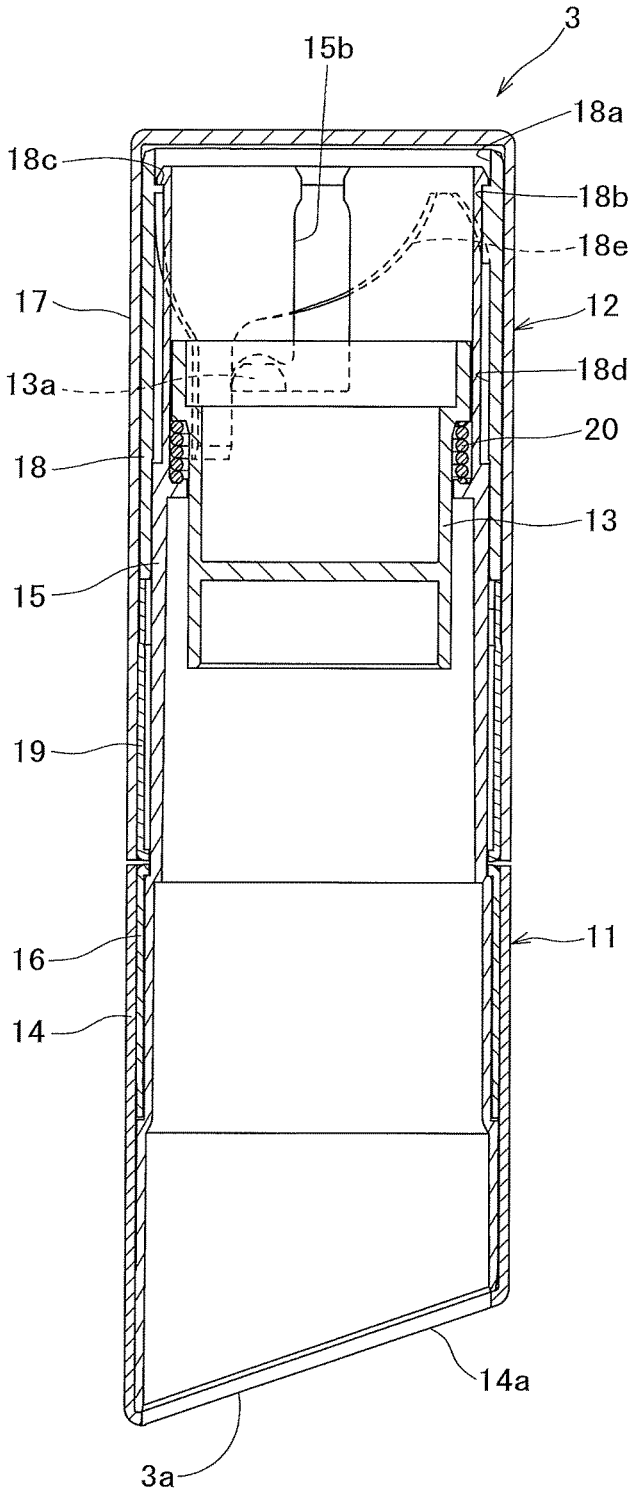
FIG. 3 is a longitudinal sectional view of the first embodiment of the present invention in a posture in which the guide protrusion is temporarily held in a temporary holding hole.

On the other hand, the cap 3 is, as shown in FIG. 3, composed of a tubular first cap portion 11 with a lower end opened so as to accommodate the container body 2 by external fitting, a tubular second cap portion 12 incorporated on an upper side of the first cap portion 11 so as to be rotatable around a longitudinal axis relative to the first cap portion 11, an inner cylinder 13 that is engaged slidably with the first and second cap portions 11 and 12, and a return spring 20 that biases the inner cylinder 13 upward.

The first cap portion 11 includes a dial portion 14 having an opening portion 14*a* at a lower end, a first guide cylinder 15 with a lower end portion provided at a lower half portion of an inner circumferential surface of the dial portion 14 in an integrated manner with the dial portion 14 and with an upper end portion projecting upward from an upper end of the dial portion 14 to overlap at an inner circumferential surface side of the second cap portion 12, and a first support cylinder 16 sandwiched between an upper half portion of the dial portion 14 and the first guide cylinder 15 and provided in an integral manner with the dial portion 14.

On the other hand, the second cap portion 12 includes a tubular-topped trunk portion 17, a second guide cylinder 18 provided at an upper half portion of an inner circumferential surface of the trunk portion 17 in an integrated manner with the trunk portion 17, and a second support cylinder 19 provided at a lower half portion of the inner circumferential surface of the trunk portion 17 in an integrated manner with the trunk portion 17.

Figure 5C:
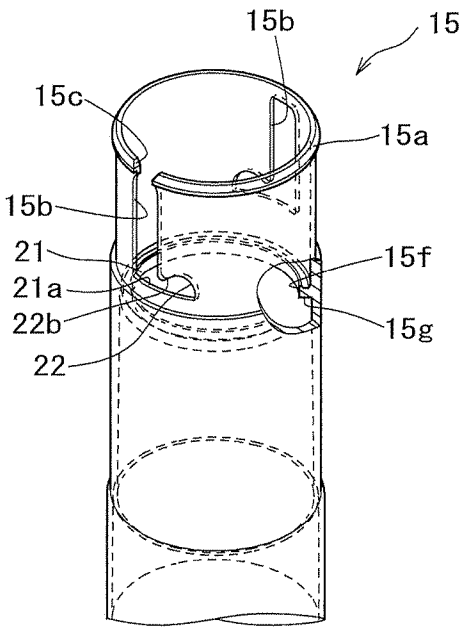
FIG. 5A, FIG. 5B, and FIG. 5C are a sectional front view, a partially sectional side view, and a partial perspective view of a first guide cylinder, respectively.
Figure 5B:
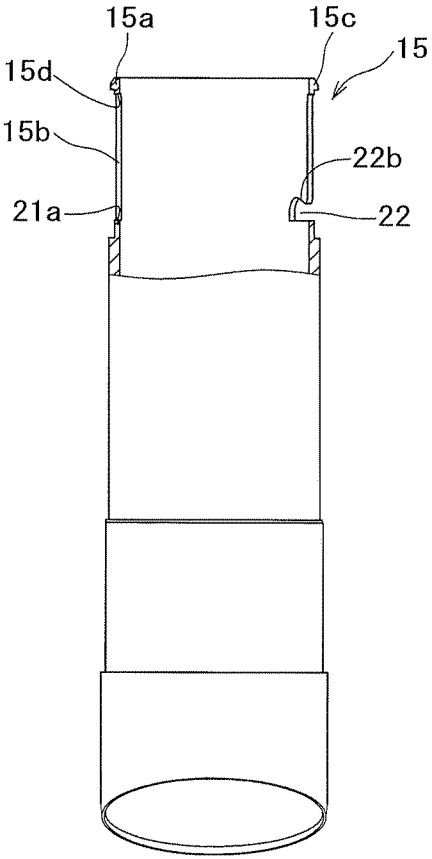
Figure 5A:
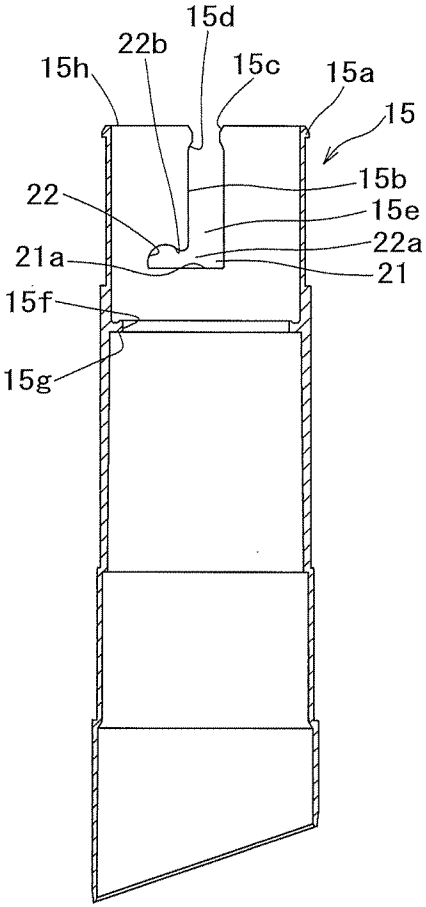

The first guide cylinder 15 is, as shown in FIG. 5, formed with a latching portion 15*a* projecting in a flange shape radially outward from an upper end edge of an outer circumferential surface, and is provided at an upper cylinder side of the first guide cylinder 15 with a pair of guide holes 15*b* of vertical line shapes that correspond to a first guide portion of the present invention, in a point symmetric manner. Moreover, in one of the pair of these guide holes 15*b*, a slit-like notch 15*c* is formed by notching from an upper end portion of the guide hole 15*b* to an upper end edge of the first guide cylinder 15 so as to have a width narrower than a hole width of the guide hole 15*b*, and the notch 15*c* brings the latching portion 15*a* into a notched state at the notched part, thereby providing a setting to allow the upper end portion of the first guide cylinder 15 to bend radially inward and outward. In addition, the notch 15*c* is formed only at the upper end portion of one of the guide holes 15*b* in the present embodiment, but may be formed at the upper end portions of both guide holes 15*b* for embodiment.

Moreover, the guide hole 15*b*, into which a guide protrusion 13*a* of the inner cylinder 13 to be described later is fitted vertically movably, is set so that upper and lower end portions of the guide hole 15*b* are positioned at upward and downward movement ends 15*d* and 15*e* of the guide protrusion 13*a*, respectively, when the first cap portion 11 and the second cap portion 12 are rotated relative to each other as to be described late. In a state where the guide protrusion 13*a* is located at the position of the upward movement end 15*d* of the guide hole 15*b*, there is a setting that an upper end face 13*f* of the inner cylinder 13 is located vertically substantially flush with an upper end face 15*h* of the first guide cylinder 15.

At the downward movement end 15*e* of the guide hole 15*b*, an extension portion 21 is formed in a manner that the guide hole 15*b* is extended (continued) further downward, and at a lower end of the extension portion 21, a temporary holding hole (temporary holding portion) 22 is formed by notching in one circumferential direction (in the present embodiment, a counterclockwise direction in a plan view), and as a result of moving the inner cylinder 13 downward against a biasing force of the return spring 20 and then rotating in one circumferential direction in a state where the guide protrusion 13*a* has reached the lower end of the extension portion 21 beyond the downward movement end 15*e* as to be described later, the guide protrusion 13*a* latches the temporary holding hole 22 to be maintained in the temporarily held state.

The temporary holding hole 22 is notched to match a shape of the guide protrusion 13*a* so that the guide protrusion 13*a* is easily temporarily held therein, and an opening portion 22*a* leading to the extension portion 21 is provided at an upper part as a slant portion 22*b* that descends in a slanted manner downwardly, so that the guide protrusion 13*a* temporarily held in the temporary holding hole 22 is not inadvertently removed from the temporary holding hole 22.

Moreover, a projection strip 15*f* that projects annularly in the radially inward direction is provided at an inner circumferential surface side of the first guide cylinder 15 and lower than the temporary holding hole 22, and an upper end 2*b* of the container body 2 in a state of being accommodated in the cap 3 abuts against a lower end face 15*g* of the projection strip 15*f*.

Figure 6A:
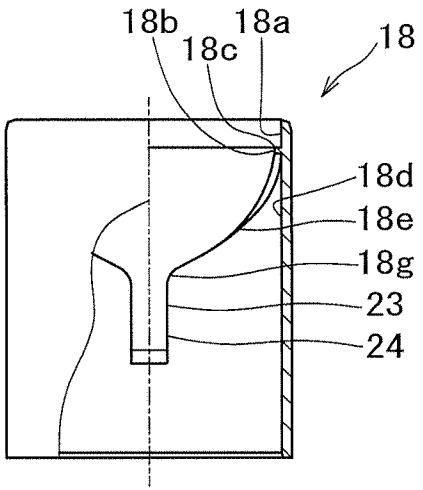
FIG. 6A, FIG. 6B, and FIG. 6C are a partially sectional front view, a sectional side view, and a bottom view of a second guide cylinder, respectively.
Figure 6B:
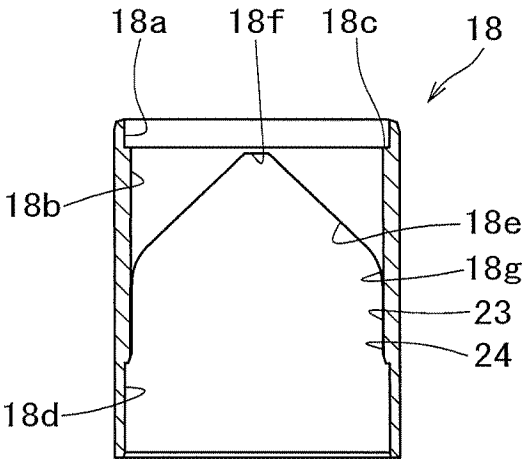
Figure 6C:
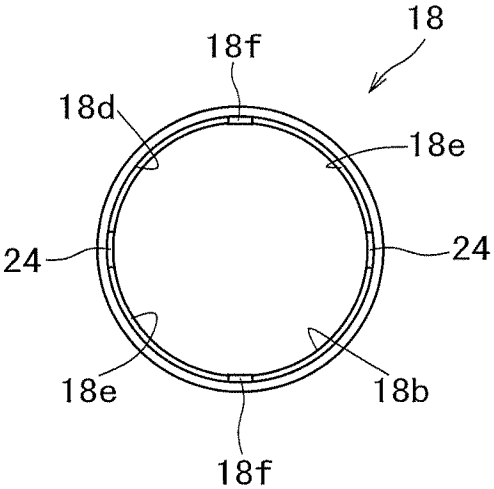

On the other hand, the second guide cylinder 18 is, as shown in FIG. 6, provided at an upper end portion of its inner circumferential surface as a first larger diameter portion 18*a*, and provided thereunder as a smaller diameter portion 18*b*, and a step formed between the first larger diameter portion 18*a* and the smaller diameter portion 18*b* serves as a latch receiving portion 18*c* with which the latching portion 15*a* latches.

Also, the second guide cylinder 18 is provided under the smaller diameter portion 18*b* as a second larger diameter portion 18*d*, and a step formed between the smaller diameter portion 18*b* and the second larger diameter portion 18*d* serves as a slanted guide step 18*e* that corresponds to a second guide portion of the present invention. The slanted guide step 18*e* is formed in pair in a line symmetric manner.

The slanted guide step 18*e* is provided at an upper end portion as an upward movement restricting end 18*f* that restricts a further upward movement of the guide protrusion 13*a* and provided at a lower end portion as a downward movement restricting end 18*g* that restricts a further downward movement of the guide protrusion 13*a*, and the upward movement restricting end 18*f* and the downward movement restricting end 18*g* are formed consecutively in a vertically slanted manner, and a vertical (longitudinal) guide length of the upward movement restricting end 18*f* and the downward movement restricting end 18*g* is coincident with a guide length between the upward and downward movement ends 15*d* and 15*e* of the guide hole 15*a*. Although a guide movement of approximately 90 degrees is performed circumferentially in the present embodiment, the present invention is not limited thereto, and may also be carried out in a manner of performing a guide movement of, for example, 60 degrees, 180 degrees, etc.

Under the downward movement restricting end 18*g* of the slanted guide step 18*e*, an extending portion 23 is formed for which the smaller diameter portion 18*b* extends downward while hanging down from the downward movement restricting end 18*g*. The extending portion 23 has a lower end portion set so as to reach vertically up to the position of the temporary holding hole 22 and is formed there with a return portion 24. Moreover, as will be described later, if the first cap portion 11 and the second cap portion 12 are rotated clockwise relative to each other with the guide protrusion 13*a* temporarily held in the temporary holding hole 22, the return portion 24 abuts against the guide protrusion 13*a* to cause a movement in a direction of pushing out the same from the temporary holding hole 22, and the guide protrusion 13*a* is accordingly removed from the temporary holding hole 22.

Figure 4A:
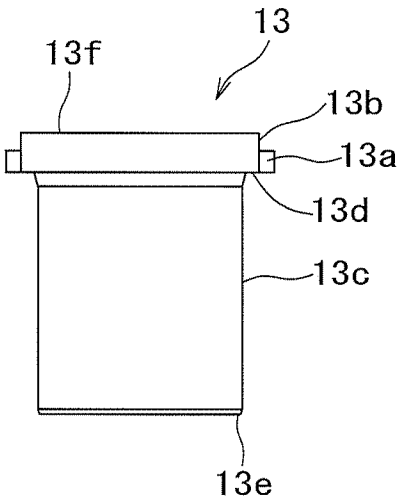
FIG. 4A, FIG. 4B, and FIG. 4C are a front view, a sectional front view, and a side view of an inner cylinder, respectively.
Figure 4B:
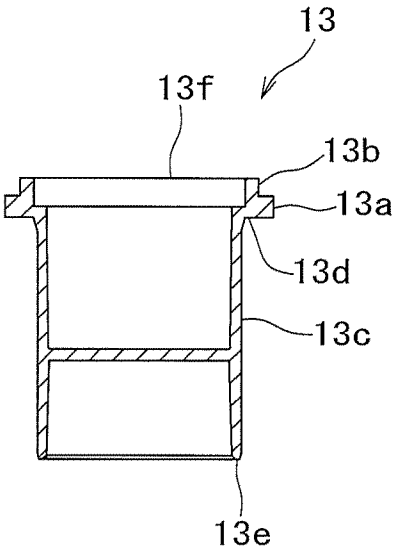
Figure 4C:
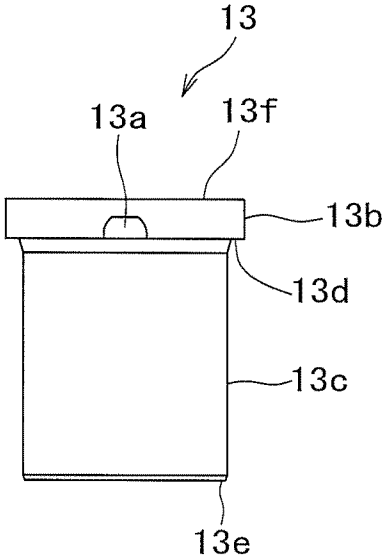

On the other hand, the inner cylinder 13 is, as shown in FIG. 4, provided at an upper end portion of its outer circumferential surface as a larger diameter portion 13*b* that vertically movably slides along the inner circumferential surface of the first guide cylinder 15, and is provided, at a lower part than the larger diameter portion 13*b*, as a smaller diameter portion 13*c* that is opposed to the inner circumferential surface of the first guide cylinder 15 with a gap therebetween. Moreover, the inner cylinder 13 is provided between the larger diameter portion 13*b* and the smaller diameter portion 13*c* as a stepped portion 13*d*. A pair of guide protrusions (which correspond to integrated first and second to-be-guided portions of the present invention) 13*a* that engage slidably with the guide holes 15*b* are formed to project radially outward from an outer circumferential surface of the larger diameter portion 13*b*. Also, a lower end edge of the inner cylinder 13 is opposed to the upper end 2*b* of the accommodated container body 2, and is provided as an abutting portion 13*e* that abuts against the upper end 2*b* of the container body 2 to make the container body 2 project through the opening portion 14*a* of the dial portion 14 when the inner cylinder 13 moves downward as to be described later. Further, the return spring (in the present embodiment, composed of a coil spring) 20 is interposed between the stepped portion 13*d* and an upper face 15*h* of the projection strip 15*f* of the first guide cylinder 15 while being fit loosely between an outer circumferential surface of the smaller diameter portion 13*c* and the inner circumferential surface of the first guide cylinder 15, and biases the inner cylinder 13 upward at all times.

Moreover, when the inner cylinder 13 is in an initial posture where the same is located at an upward movement end position, the guide protrusion 13*a* is located at the upward movement restricting end 18*f* of the slanted guide step 18*e* through the upper end portion of the guide hole 15*b* located on a radially identical line. If the trunk portion 17 is rotated relative to the dial portion 14 in a direction in which the guide protrusion 13*a* is guided for downward movement by the slanted guide step 18*e* with the dial portion 14 and the trunk portion 17 gripped with both hands in this initial posture state, the guide protrusion 13*a* then moves downward by being guided by the slanted guide step 18*e* and also moves downward by being guided by the guide hole 15*b*, as well, and the inner cylinder 13 accordingly moves downward without rotating with respect to the first guide cylinder 15 while being against the return spring 20, but moves downward while rotating with respect to the second guide cylinder 18. By the abutting portion 13*e* pushing down the container body upper end 2*b* as a result of the downward movement of the inner cylinder 13, the container body 2 is then pushed down to make a lower end 2*c* of the container body project through the opening portion 14*a* of the dial-portion lower end.

Moreover, if either one hand is released in the projecting posture where the lower end 2*c* of the container body 2 projects from a cap lower end 3*a*, a load to make the inner cylinder 13 move upward acts due to the biasing force of the return spring 20, so that the guide protrusion 13*a* moves upward while being guided by the guide hole 15*b* and simultaneously moves upward while being guided by the slanted guide step 18*e*. Accordingly, the second cap portion 12 returns to a position before the relative rotation, and the inner cylinder 13 returns to the initial posture. Thereafter the container body 2 can be taken out by gripping the lower end 2*c* of the container body 2 in the projecting posture state and drawing out the same from the cap lower end 3*a*, and the cosmetic can be used by making the rod-shaped cosmetic K of the container body 2 ascend and descend.

When accommodating the container body 2 in the cap 3 after using the rod-shaped cosmetic K, it suffices to insert the upper end of the container body 2 from the lower end 3*a* of the cap to push the same thereinto until abutting against the lower end face 15*g* of the projection strip 15*f* and the abutting portion 13*e* of the inner cylinder 13.

In addition, the inner circumferential surface of the first guide cylinder 15 at a side lower than the projection strip 15*f* makes sliding contact with each outer circumferential surface of the petticoat cylinder 4, the middle tool 5, and the gripping cylinder 10 of the container body 2 accommodated in the cap 3, so that the accommodated container body 2 does not inadvertently drop out of the cap 3.

Next, description will be given of a procedure for assembling the cap 3.

The cap 3 will be assembled by respectively assembling the first cap portion 11 and the second cap portion 12, then incorporating the return spring 20 and the inner cylinder 13 into the first cap portion 11, and thereafter combining both cap portions 11 and 12, and in which the first cap portion 11 is assembled by internally fitting the first guide cylinder 15 and the first support cylinder 16 to the dial portion 14, and the second cap portion 12 is assembled by internally fitting the second guide cylinder 18 and the second support cylinder 19 to the trunk portion 17.

Figure 7A:
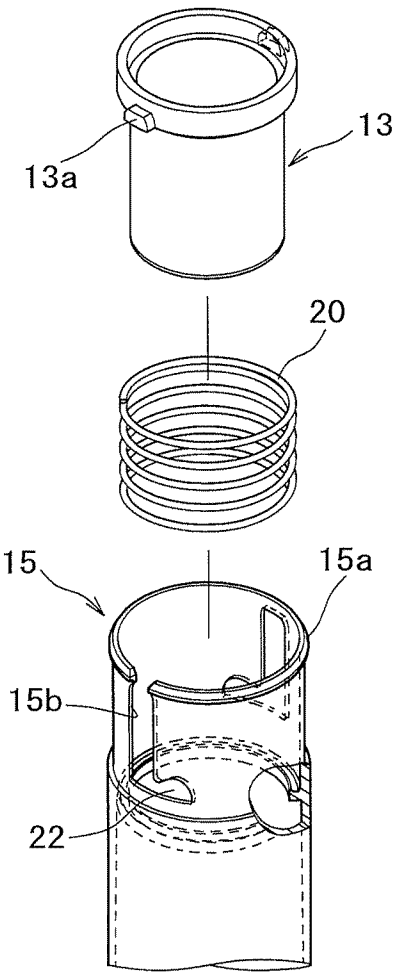
FIG. 7A, FIG. 7B, FIG. 7C, and FIG. 7D are explanatory views respectively showing states where a first guide cylinder, a return spring, and an inner cylinder are integrated in the first embodiment.

Then, into the assembled first cap portion 11, as shown in FIG. 7A, the return spring 20 and the inner cylinder 13 will be incorporated, and for which the inner cylinder 13 is incorporated into the first guide cylinder 15 from the upper end side while internally fitting the inner cylinder 13 to the return spring 20 with the return spring 20 having been internally fitted from the upper end portion of the first guide cylinder 15 to make the lower end of the spring be latched on the upper face 15*h* of the projection strip 15*f*.

Figure 7B:
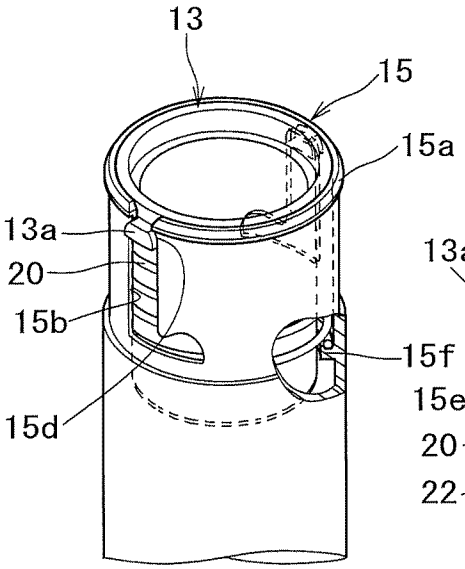

At this time, the guide protrusions 13*a* projecting from both right and left side surfaces of the inner cylinder 13 will be respectively engaged with the pair of guide holes 15*b* formed in the first guide cylinder 15 (the state in FIG. 7B). If one of the guide protrusions 13*a* is pushed in while being abutted against the upper end portion of the guide hole 15*b* where the notch 15*c* is formed, the upper end portion of the first guide cylinder 15 is deformed to bend radially outward and expand the notch 15*c*, so the guide protrusion 13*a* is fitted with the guide hole 15*b*. Further, if the inner cylinder 13 is pushed in with the notch 15*c* kept expanded, the other guide protrusion 13*a* passes over the upper end portion of a non-notched part of the first guide cylinder 15 to be fitted with the guide hole 15*b*. This allows smoothly performing incorporation of the inner cylinder 13 into the first guide cylinder 15.

Figure 7C:
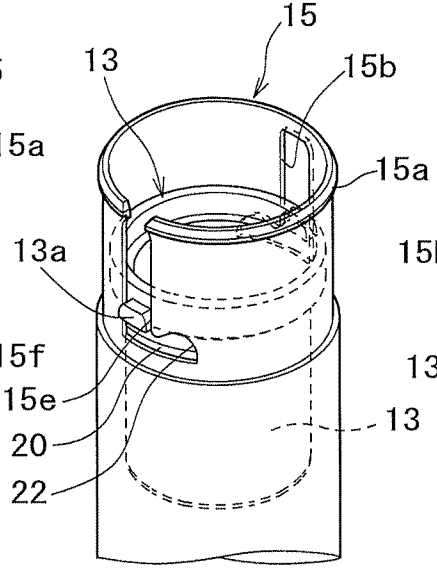
Figure 7D:
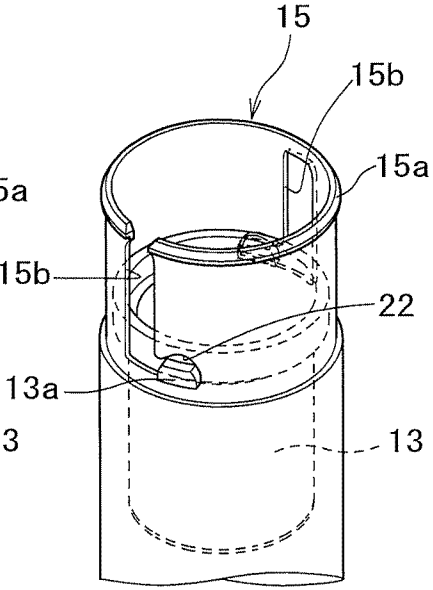

The inner cylinder 13 with the guide protrusions 13*a* fitted with the guide holes 15*b* is thus pushed down beyond the guide-hole downward movement end 15*d* (the state in FIG. 7C), and if the downward movement stops as a result of the guide protrusion 13*a* abutting against a lower end edge 21*a* of the extension portion 21, the inner cylinder 13 is now rotated circumferentially to fit the guide protrusion 13*a* into the temporary holding hole 22 so as to be temporarily held (the state shown in FIG. 7D). By thus making the guide protrusion 13*a* be temporarily held in the temporary holding hole 22, the inner cylinder 13 is maintained latched in the temporary holding hole 22 without moving toward the upward movement end 15*d* even when the inner cylinder 13 receives the biasing force due to the return spring 20.

Figure 8C:
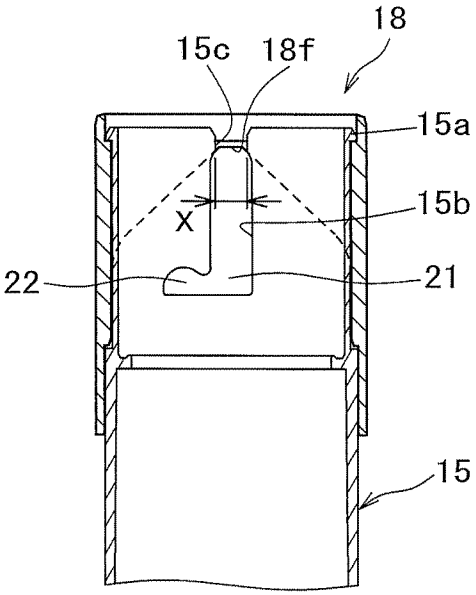
FIG. 8A, FIG. 8B, and FIG. 8C are explanatory views respectively showing states where the second guide cylinder is integrated in the first guide cylinder.
Figure 8B:
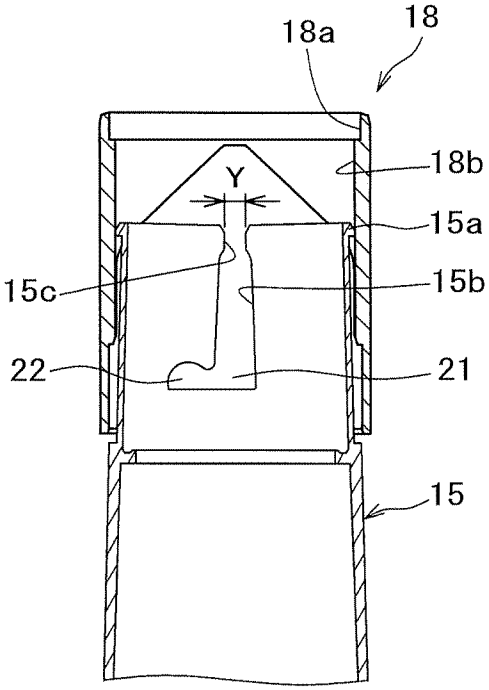
Figure 8A:
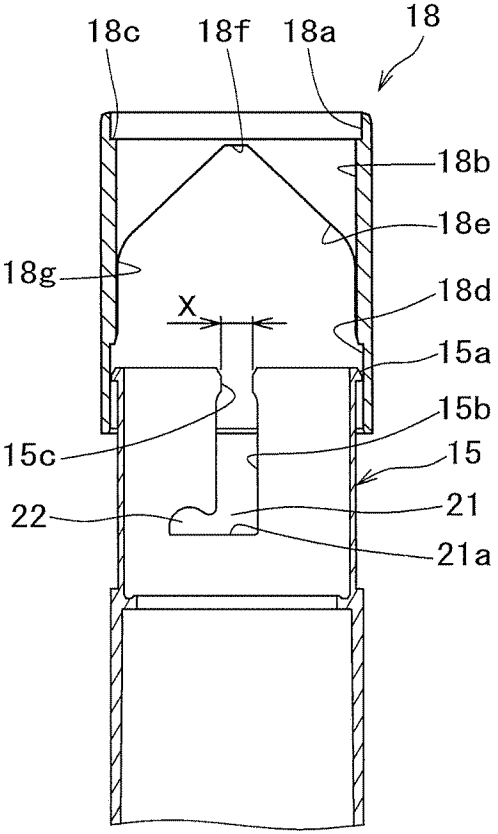

To the first cap portion 11 thus brought into the state with the inner cylinder 13 temporarily held therein, the second cap portion 12 will be incorporated by external fitting to complete the assembly of the cap 3. Here, the second guide cylinder 18 is assembled onto the first guide portion 15 by the smaller diameter portion 18*b* passing over the latching portion 15*a* formed at the upper end edge of the first guide cylinder 15 to be gradually fitted therewith and the latching portion 15*a* latching with the latch receiving portion 18*c*. Moreover, because the inner cylinder 13 has at this time been held in advance in the temporary holding hole 22 provided at a lower side, the upper end portion of the inner cylinder 13 is located at a position lower than the upper end portion of the first guide cylinder 15. When the smaller diameter portion 18*b* of the second guide cylinder 18 passes over the latching portion 15*a* of the first guide cylinder 15, the upper end portion of the first guide cylinder 15 is pushed inward by the smaller diameter portion 18*b* of the second guide cylinder 18 to have an interval X of the notch 15*c* made as a narrow interval Y (X>Y) as shown in FIG. 8A and FIG. 8B, so the upper end portion of the first guide cylinder 15 is deformed to bend radially inward. Accordingly, the second guide cylinder 18 can thereby be externally fitted to the first guide cylinder 15 smoothly without being obstructed by the inner cylinder 13. Moreover, after the smaller diameter portion 18*b* passes the latching portion 15*a*, the bending deformation of the upper end portion of the first guide cylinder 15 is restored and the latch receiving portion 18*c* of the second guide cylinder 18 latches with the latching portion 15*a*, so that a downward movement of the first guide cylinder 15 with respect to the second guide cylinder 18 is restricted.

As a result of the latching portion 15*a* thus latching with the latch receiving portion 18*c*, assembly between the first cap portion 11 and the second cap portion 12 is achieved. In this state, the inner cylinder 13 remains located at a lower position where the same is temporarily held in the temporary holding hole 22. Then, by rotating the second cap portion 12 clockwise relative to the first cap portion 11, the return portion 24 of the second guide cylinder 18 pushes the guide protrusion 13*a* held in the temporary holding hole 22 of the first guide portion 15 out of the temporary holding hole 22 to move the same up to the extension portion 21. When the guide protrusion 13*a* has moved up to the extension proton 21, the inner cylinder 13 moves to a position where the guide protrusion 13*a* abuts against the upward movement end 15*d* of the guide hole 15 of the first guide cylinder 15 under the biasing force of the return spring 20. Incorporation of the cap portion 3 is thereby completed.

Moreover, when the second cap portion 12 is rotated relative to the first cap portion 11 in this completion state, the inner cylinder 13 moves upward or downward as a result of the guide protrusion 13*a* being guided by the guide hole 15*b* and the slanted guide step 18*e*, and the position of a most downward movement of the inner cylinder 13 is no lower than the downward movement restricting end 18*g* of the slanted guide step 18*e* and never reaches the extension portion 21 beyond the downward movement end 15*e* of the guide hole 15*b*, and consequently, the guide protrusion 13*a* is prevented from erroneously entering the temporary holding hole 22.

Figures 12A, 12B, 12C, 12D, 12E:
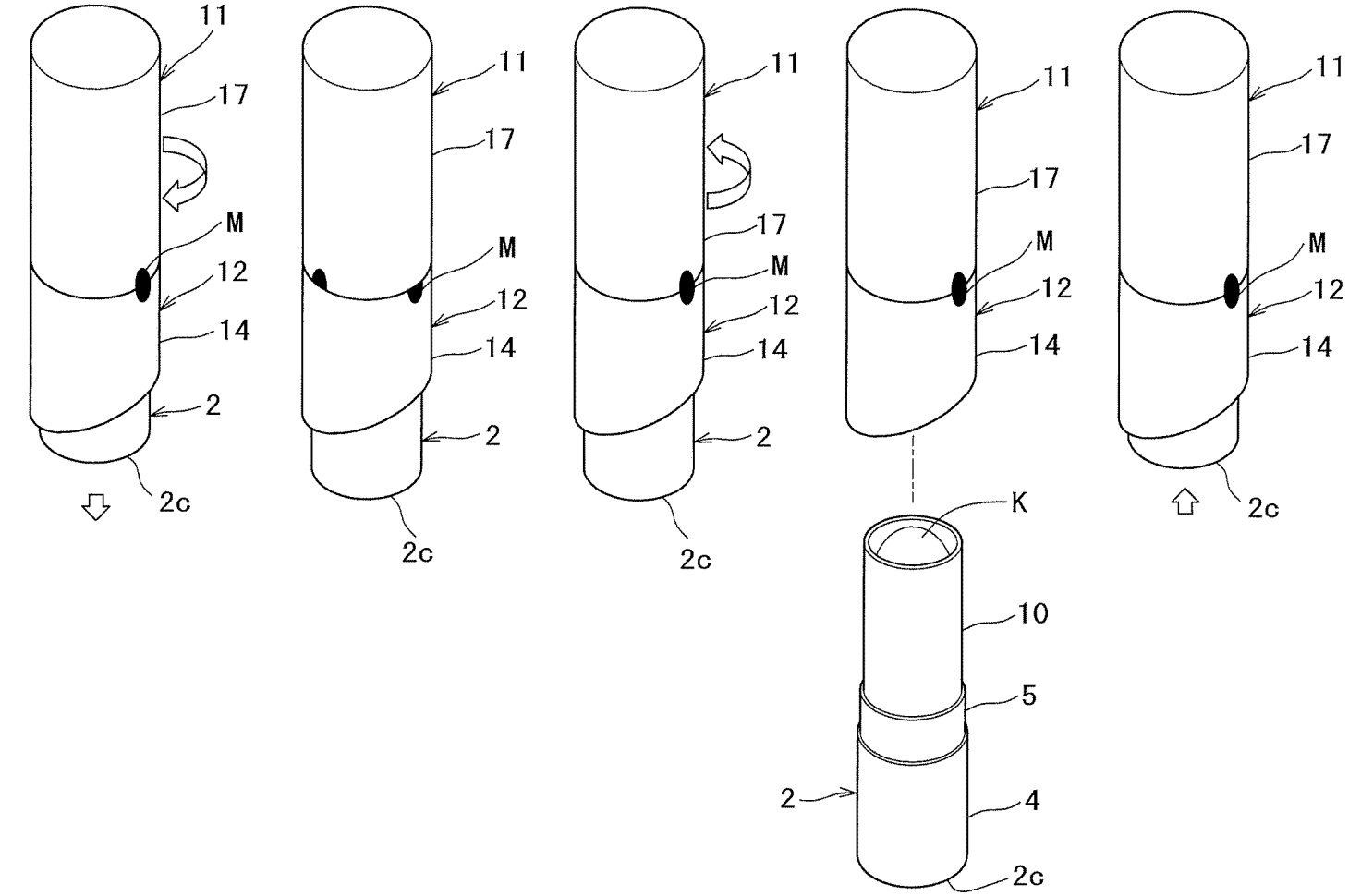
FIG. 12A to FIG. 12E are perspective views showing an accommodated posture of a container body, a projecting posture of the container body, a state in which the container body is a projecting posture and a cap has returned to an initial state, a state in which the container body has been detached from the cap, and a state in which the container body is pushed into the cap to reach an accommodated posture, respectively.

With the first embodiment of the present invention arranged in the above-described manner, for taking out the container body 2 from the cap 3, when the trunk portion 17 is rotated relative to the dial portion 14 as in the foregoing (refer to FIG. 12A), the guide protrusion 13*c* is guided to move downward by the slanted guide groove 18*a* and guided up to the downward movement end 15*e* of the guide hole 15*a*, so that the abutting portion 13*d* of the inner cylinder 13 pushes out the container-body upper end 2*b* toward the cap lower end 3*a* (refer to FIG. 12B). In this pushing-out state, when either of the hands that have performed the relative rotation is released, the inner cylinder 13 moves upward under the biasing force of the return spring 20, and returns therewith to the initial posture in which the guide protrusion 13*c* is located at the upward movement end of the guide hole 15*a* and the slanted guide groove 18*a*, but the container body 2 is maintained in the projecting posture state where the lower end 2*c* is projecting from the cap lower end 3*a* (refer to FIG. 12C). Drawing out the container body 2 from the cap 3 in this state and performing the bring-up operation of the container body 2 allows use of the rod-shaped cosmetic K filled in the container body 2 (refer to FIG. 12D). It then suffices after using the rod-shaped cosmetic K, to perform the bring-back operation of the container body 2 so as to store the rod-shaped cosmetic K, then to insert the container-body upper end 2*b* through the opening portion 14*a* that is the cap lower end 3*a*, and to push the container body 2 toward a back end of the cap 3 until the upper end 2*b* abuts against the abutting portion 13*e* (refer to FIG. 12E).

When one of the hands that have gripped the same to cause a relative rotation is released after pushing out the container body 2 from the cap 3 by causing a relative rotation between the first and second cap portions 11 and 12, the first and second cap portions 11 and 12 automatically return to the original posture under the biasing force of the return spring 20. For assembling such a cap 3 of the rod-shaped cosmetic container 1, after the first and second cap portions 11 and 12 are respectively separately formed by incorporation, the return spring 20 and the inner cylinder 13 are then incorporated by internal fitting to the first cap portion 11 in a loosely fit manner, and the second cap portion 12 is incorporated by external fitting to the first cap portion 11 incorporated with the return spring 20 and the inner cylinder 13.

Figure 9A:
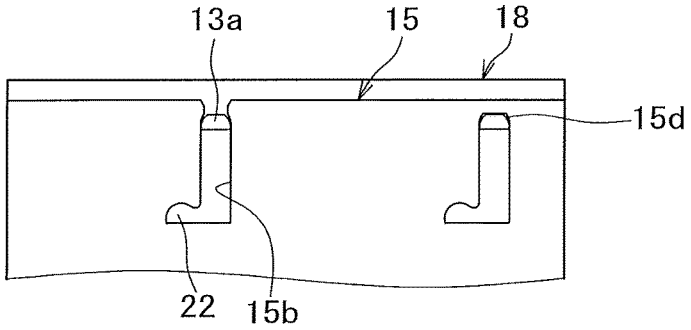
FIG. 9A to FIG. 9E are development views respectively showing engagement states of a guide hole, a slanted guide step, and a guide protrusion in the first embodiment.
Figure 9B:
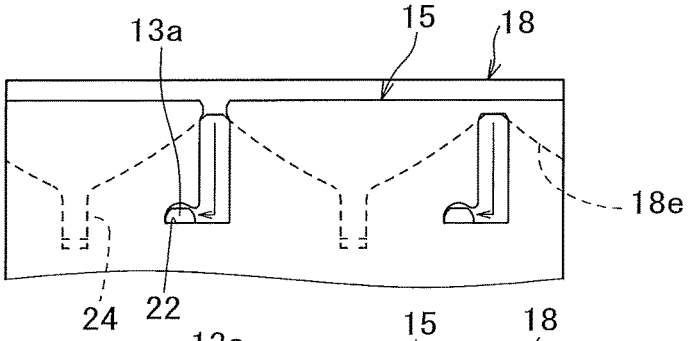

At this time, moving the inner cylinder 13 by pushing down from the position in the initial posture shown in FIG. 7B and FIG. 9A until being located at the lower end of the extension portion 21 against the biasing force of the return spring 20 (refer to FIG. 7C), and then rotating the same circumferentially to make the guide protrusion 13*a* be held in the temporary holding hole 22 so as to have the upper end portion of the inner cylinder 13 in a state of being temporarily held at a position lower than the upper end position of the first guide cylinder 15 (refer to FIG. 7D) allows the upper end portion of the first guide cylinder 15 to be deformed to bend radially inward. When the second guide cylinder 18 is externally fitted by force fitting to the first guide cylinder 15 in this state, external fitting in a manner of the smaller diameter portion 18*b* of the second guide cylinder 18 passing over the larger-diameter latching portion 15*a* of the first guide cylinder 15 is smoothly performed (refer to FIG. 8A and FIG. 8B, the state in FIG. 9B). Moreover, when the smaller diameter portion 18*b* passes the latching portion 15*a*, the bending deformation is restored, so the latch receiving portion 18*c* securely latches with the latching portion 15*a* (the state in FIG. 8C), so that a downward movement in the down-direction of the first guide cylinder 15 with respect to the second guide cylinder 18 is thereby restricted. Accordingly, final assembly of the first and second cap portions 11 and 12 can be easily and reliably performed even when it involves fitting by force fitting.

Figure 9C:
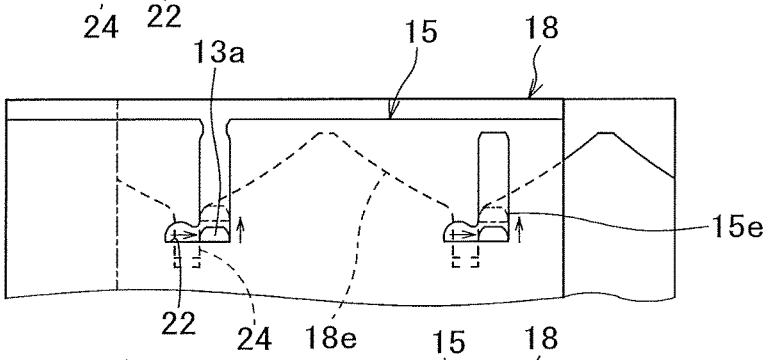
Figure 9D:
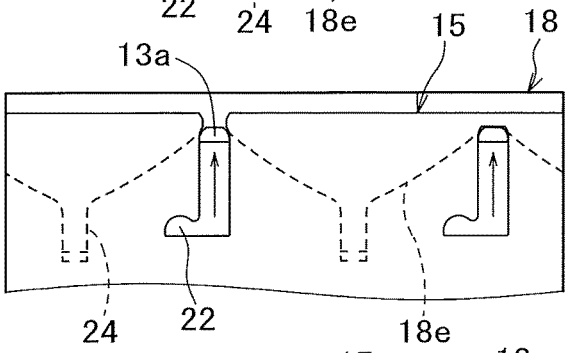
Figure 9E:
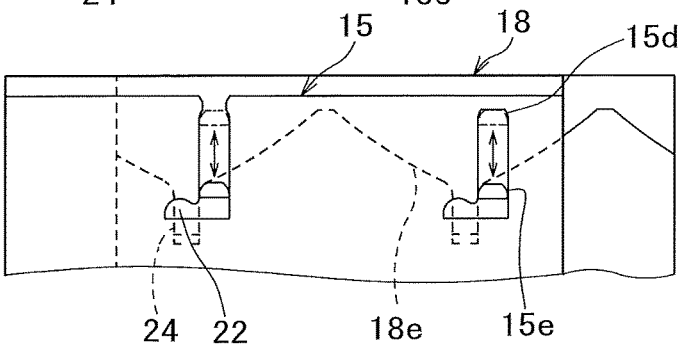

After the incorporation of the first and second cap portions 11 and 12 thus ends, by rotating the second guide cylinder 18 circumferentially relative to the first guide cylinder 15, the return portion 24 formed in the second guide cylinder 18 pushes out the guide protrusion 13*a* formed in the first guide cylinder 15 from the temporary holding hole 22, and the guide protrusion 13*a* is pushed out from the temporary holding hole 22 to move to the lower end edge 21*a* of the extension portion 21, and then moves (moves upward) up to the downward movement end 15*e* due to the biasing force of the return spring 20 (refer to FIG. 9C). When the hand that has caused the relative rotation is released in this state, the guide protrusion 13*a* moves upward due to the biasing force of the return spring 20 and rotates the slanted guide step 18*e* relative to the guide hole 15*b* while moving up to the position of the upward movement end 15*d* of the guide hole 15*b* (refer to FIG. 9D). Moreover, once being removed from the temporary holding hole 22, the guide protrusion 13*a* repeats a movement of moving to the downward movement end 15*e* of the guide hole 15*b* as a result of rotating the first and second cap portions 11 and 12 (first and second guide cylinders 15 and 18) relative to each other to reach a downward-moving posture in which the inner cylinder 13 pushes out the cylinder body 2 downward from the cap 3 and moving to the upward movement end 15*d* of the guide hole 15*b* as a result of releasing the hand having performed a relative rotation to reach an initial posture (refer to FIG. 9E), so that the guide protrusion 13*a* does not move to a lower side than the downward movement end 15*e* of the guide hole 15*b* and the downward movement restricting end 18*g* of the slanted guide step 18*e*. Accordingly, there is no such case that the guide protrusion 13*a* inadvertently enters the temporary holding hole 22 during a relative rotation operation of the cap 3, which therefore does not affect normal use of the cap.

Also, with the cap 2 thus arranged, the guide protrusion 13, the first guide cylinder 15, and the second guide cylinder 18 can be arranged in the same radial position of the first or second cap portion 11, 12, and the temporary holding portion 22 and the return portion 24 can also be arranged in the same radial position of the first or second cap portion 11, 12, as well, so that it is not necessary to provide a large place for arrangement of the first guide cylinder 11 and the second guide cylinder 12 and the temporary holding hole 22 and the return portion 24, which allows space saving.

Further, the guide protrusion 13*a* of the inner cylinder 13 is temporarily held in the temporary holding hole 22 formed lower than the downward movement end of the slanted guide step 18*e*, so that radially inward bending deformation of the upper end portion of the first guide cylinder 15 in a temporarily held state of the inner cylinder 13 can be reliably performed.

Also, an arrangement is provided for performing bending deformation of the upper end portion of the first guide cylinder 15 by the slit-like notch 15*c*, which can therefore ensure radially inward bending deformation of the first guide cylinder 15 as a result of external fitting of the second guide cylinder 18 in a force fitting manner.

Figure 10:
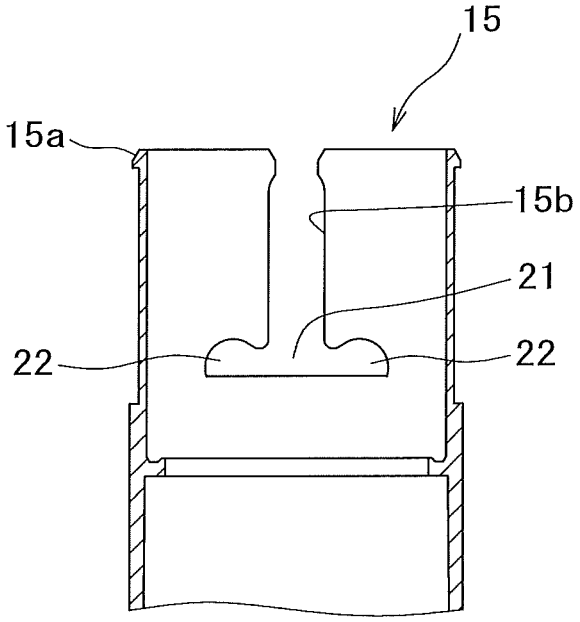
FIG. 10 is a partially sectional view of a first guide cylinder in a second embodiment.

Of course, the present invention is not restricted to the first embodiment described above, the temporarily holding hole may not be formed in only one circumferential direction from the lower end of the extension portion 21, but may also be, as in a second embodiment shown in FIG. 10, formed by notching in both circumferential directions from the lower end of the extension portion 21, and thus forming the temporary holding hole 22 in both right and left directions from the extension portion 21 enables the inner cylinder 13 pushed down until the guide protrusion 13*a* abuts against the lower end of the extension portion to make the guide protrusion 13*a* be held in the temporary holding hole 22 even in either circumferential direction it is rotated, which allows providing temporary holding work with versatility.

Figure 11A:
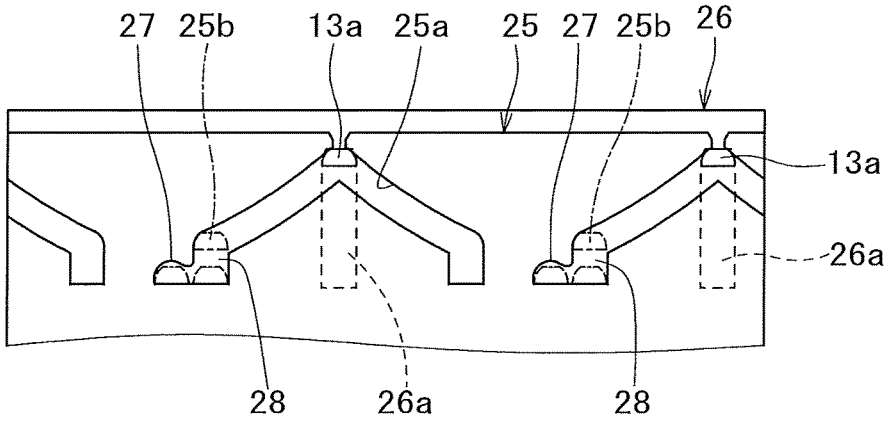
FIG. 11A and FIG. 11B are development views showing engagement states of a guide hole, a slanted guide step, and a guide protrusion in third and fourth embodiments, respectively.
Figure 11B:
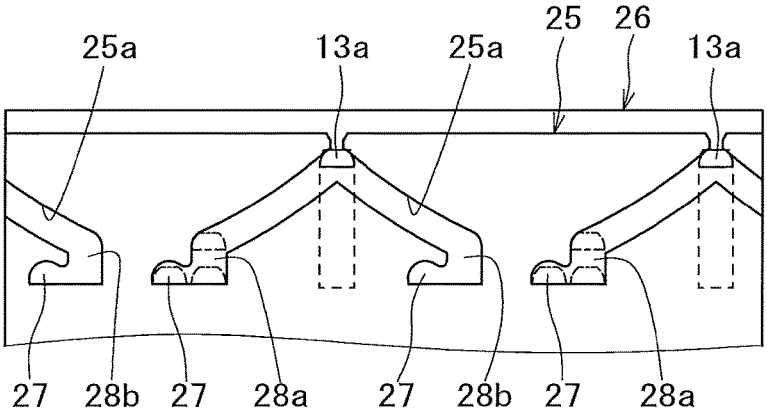

Also, in the first embodiment, there is an arrangement for which the vertical hole-like guide hole 15*b* is formed in the first guide cylinder 15 and the slanted guide step 18*e* is formed in the second guide cylinder 18. However, as in a third embodiment shown in FIG. 11A, there may be an arrangement for which a slanted guide hole 25*a* for vertically guiding the guide protrusion 13*a* in a slanted manner is formed in a first guide cylinder 25 and a vertical groove-like guide groove 26*a* for vertically guiding the guide protrusion 13*a* is formed in a second guide cylinder 26 so that the guide protrusion 13*a* penetrates through the slanted guide hole 25*a* to engage with the guide groove 26*a*. In this case, there may be an arrangement for a temporary holding hole 27 that is formed while being notched in one circumferential direction from the lower end of an extension portion 28 notched so as to hang down toward the downside from a downward movement restricting end 25*b* that is at one side of the slanted guide hole 25*a*. Also, as shown in FIG. 11B, temporary holding holes 27 may be respectively formed so as to be in the same circumferential direction for respective extension portions 28*a* and 28*b* formed at both right and left sides of the slanted guide hole 25*a*. In this case, with either circumferential direction of the direction in which the temporary holding holes 27 are formed, the present invention can likewise be carried out.

Further, with the present invention, there is an arrangement for a relative movement between the first and second cap portions to push out the container body that can be performed in both clockwise and counterclockwise directions, but a relative movement only in either direction may be performed, and further, a guide portion to be formed on the second guide cylinder side may not be formed in a step shape as in the embodiment described above, but may be formed in a groove shape or a hole shape.

INDUSTRIAL APPLICABILITY

The present invention is applicable to the field of rod-shaped cosmetic containers for accommodating cosmetics such as lipstick, nail polish, foundation, etc.

DESCRIPTION OF SYMBOLS

1 Rod-shaped cosmetic container
2 Container body
3 Cap
11 First cap portion
12 Second cap portion
13 Inner cylinder
13*c* Guide protrusion
15 First guide cylinder
15*a* Latching portion
15*b* Guide hole
18 Second guide cylinder
18*a* Slanted guide step
18*c* Latch receiving portion
20 Return spring
22 Temporary holding hole

The invention claimed is:

1. A rod-shaped cosmetic container including a container body being filled with a rod-shaped body such as a rod-shaped cosmetic, and a cap being externally fitted to the container body from an upper side to accommodate the container body, wherein the cap comprising:

a tubular first cap portion with a lower end opened so as to accommodate the container body by external fitting;

a tubular second cap portion incorporated by external fitting to an upper part of the first cap portion so as to be rotatable around a longitudinal axis relative to the first cap portion; and an inner cylinder internally fitted to the upper part of the first cap portion vertically movably, one of the first and second cap portions is formed with a first guide portion for guiding in a vertical line shape in a vertical direction, and the other is formed with a second guide portion for guiding in a vertically slanted shape in a circumferential direction, the inner cylinder is formed with an abutting portion that abuts against the container body so that the container body projects from a cap lower end, a first to-be-guided portion that is guided so as to move upward or downward by the first guide portion, and a second to-be-guided portion that is guided so as to move upward or downward by the second guide portion, the inner cylinder is structured to move downward so as to make the container body project from the cap lower end as a result of the first and second to-be-guided portions being respectively guided by the first and second guide portions to move downward, by rotating the second cap portion relative to the first cap portion from an initial posture in which the first and second to-be-guided portions are respectively located at upward movement end positions, while the cap is provided with a return spring for returning the second cap portion to a pre-relative rotation position and returning the inner cylinder to the initial posture, and an upper end portion of the first cap portion is formed with a latching portion that is fitted into the second cap portion in a force fitting manner to latch with a latch receiving portion formed in an upper end portion of the second cap portion when the second cap portion is incorporated by external fitting to the first cap portion, and is arranged so as to restrict a downward movement of the first cap portion with respect to the second cap portion, and when further arranging the upper end portion of the first cap portion so as to bend radially inward so that the latching portion of the first cap portion is fitted into the second cap portion in a force fitting manner to latch with the latch receiving portion of the second cap portion as a result of the upper end portion of the first cap portion bending radially inward when the second cap portion is externally fitted to the first cap portion, in the first or second guide portion formed in the first cap portion, a temporary holding portion is continuously provided that temporarily holds the first or second to-be-guided portion removably so that the inner cylinder incorporated by internal fitting into the first cap portion sinks in downward against the return spring so as to allow radially inward bending deformation of the upper end portion of the first cap portion.

2. The rod-shaped cosmetic container according to claim 1, wherein the second cap portion is provided with a return portion for returning the first or second to-be-guided portion temporarily held by the temporary holding portion to the first or second guide portion, respectively.

3. The rod-shaped cosmetic container according to claim 2, wherein the return portion is located at a position displaced circumferentially with respect to the first or second to-be-guided portion temporarily held by the temporary holding portion, and abuts against the first or second to-be-guided portion temporarily held by the temporary holding portion and pushes the same away by a relative rotation between the first cap portion and the second cap portion to cause removal of the first or second to-be-guided portion from the temporary holding portion.

4. The rod-shaped cosmetic container according to claim 1, wherein the first and second guide portions overlap inside and outside in an upper half portion of the cap so that either one is located inside, and the first and second to-be-guided portions are integral, and the integral to-be-guided portion penetrates through the inner guide portion to be engaged with the outer guide portion.

5. The rod-shaped cosmetic container according to claim 2, wherein the temporary holding portion is formed so as to continue circumferentially with respect to a lower end of the first guide portion, and the return portion is provided on a longitudinally lower side with respect to a lower end of the second guide portion.

6. The rod-shaped cosmetic container according to claim 5, wherein the temporary holding portion and the lower end of the first guide portion are continuously provided while being interposed with an extension portion, and the return portion is formed in an extending portion that is extended toward a lower side than a lower end position of the second guide portion so as to correspond to a position of the temporary holding portion.

7. The rod-shaped cosmetic container according to claim 2, wherein the temporary holding portion is formed so as to continue circumferentially with respect to a lower end of the second guide portion, and the return portion is provided on a longitudinally lower side with respect to a lower end of the first guide portion.

8. The rod-shaped cosmetic container according to claim 7, wherein the temporary holding portion and the lower end of the second guide portion are continuously provided while being interposed with an extension portion, and the return portion is formed in an extending portion that is extended toward a lower side than a lower end position of the first guide portion so as to correspond to a position of the temporary holding portion.

9. The rod-shaped cosmetic container according to claim 1, wherein at least one upper end portion of the first or second guide portion formed in the first cap portion is provided like a slit that is notched up to an upper end of the first cap portion so as to allow radially inward bending deformation of the upper end portion of the first cap portion.

10. The rod-shaped cosmetic container according to claim 2, wherein the first and second guide portions overlap inside and outside in an upper half portion of the cap so that either one is located inside, and the first and second to-be-guided portions are integral, and the integral to-be-guided portion penetrates through the inner guide portion to be engaged with the outer guide portion.

11. The rod-shaped cosmetic container according to claim 10, wherein the temporary holding portion is formed so as to continue circumferentially with respect to a lower end of the first guide portion, and the return portion is provided on a longitudinally lower side with respect to a lower end of the second guide portion.

12. The rod-shaped cosmetic container according to claim 10, wherein the temporary holding portion is formed so as to continue circumferentially with respect to a lower end of the second guide portion, and the return portion is provided on a longitudinally lower side with respect to a lower end of the first guide portion.

* * * * *